US012680185B2

(12) United States Patent
Miyoshi et al.

(10) Patent No.: US 12,680,185 B2
(45) Date of Patent: Jul. 14, 2026

(54) ORGANIC HYDRIDE PRODUCTION DEVICE, WATER REMOVAL DEVICE, AND WATER REMOVAL METHOD

(71) Applicants: ENEOS Corporation, Tokyo (JP); DE NORA PERMELEC LTD, Fujisawa (JP)

(72) Inventors: Kota Miyoshi, Tokyo (JP); Hideo Otsu, Fujisawa (JP); Hiroki Domon, Fujisawa (JP); Jun Sunami, Fujisawa (JP)

(73) Assignees: ENEOS CORPORATION, Tokyo (JP); DE NORA PERMELEC LTD, Fujisawa (JP)

( * ) Notice: Subject to any disclaimer, the term of this patent is extended or adjusted under 35 U.S.C. 154(b) by 547 days.

(21) Appl. No.: 18/255,643

(22) PCT Filed: Nov. 22, 2021

(86) PCT No.: PCT/JP2021/042828
§ 371 (c)(1),
(2) Date: Jun. 2, 2023

(87) PCT Pub. No.: WO2022/118695
PCT Pub. Date: Jun. 9, 2022

(65) Prior Publication Data

US 2024/0102192 A1 Mar. 28, 2024

(30) Foreign Application Priority Data

Dec. 3, 2020 (JP) ..... 2020-200979

(51) Int. Cl.
*C25B 15/08* (2006.01)
*C25B 3/03* (2021.01)
(Continued)

(52) U.S. Cl.
CPC ..... *C25B 15/083* (2021.01); *C25B 3/03* (2021.01); *C25B 9/19* (2021.01); *C25B 15/023* (2021.01); *C25B 15/087* (2021.01)

(58) Field of Classification Search
None
See application file for complete search history.

(56) References Cited

U.S. PATENT DOCUMENTS

2013/0313127 A1 11/2013 Sato et al.
2014/0144774 A1 5/2014 Hirashige et al.
(Continued)

FOREIGN PATENT DOCUMENTS

CN 104204304 A 12/2014
CN 106715759 A 5/2017
(Continued)

OTHER PUBLICATIONS

Office Action (Substantive Examination Report) issued on Jul. 3, 2024, in corresponding Saudi Arabian Patent Application No. 523441001 and English translation of the Office Action. (12 pages).
(Continued)

*Primary Examiner* — Alexander W Keeling
(74) *Attorney, Agent, or Firm* — BUCHANAN, INGERSOLL & ROONEY PC

(57) ABSTRACT

An organic hydride production device includes an electrolyzer and a water removal device. The electrolyzer has a cathode chamber. The water removal device has a container that stores a catholyte fed from the cathode chamber, a drain pipe that discharges dragged water from the container, a detector that detects that the dragged water has been accumulated in the container, and a switcher that is provided in the drain pipe, is capable of switching between a regulation state in which drainage from the drain pipe is regulated and an execution state in which the drainage is executed, and
(Continued)

switches from the regulation state to the execution state based on a detection result of the detector.

7 Claims, 2 Drawing Sheets

(51) Int. Cl.
*C25B 9/19* (2021.01)
*C25B 15/023* (2021.01)

(56) References Cited

U.S. PATENT DOCUMENTS

| | | | | |
|---|---|---|---|---|
| 2015/0008138 | A1 | 1/2015 | Sato et al. | |
| 2016/0017503 | A1* | 1/2016 | Kaczur | C25B 3/25 205/346 |
| 2016/0281246 | A1* | 9/2016 | Lilga | C25B 9/19 |
| 2017/0292198 | A1 | 10/2017 | Mitsushima et al. | |
| 2019/0264340 | A1* | 8/2019 | Mitsushima | C25B 15/08 |
| 2019/0352786 | A1 | 11/2019 | Mitsushima et al. | |
| 2020/0080212 | A1 | 3/2020 | Mitsushima et al. | |

FOREIGN PATENT DOCUMENTS

| | | | |
|---|---|---|---|
| CN | 109996905 | A | 7/2019 |
| CN | 110546307 | A | 12/2019 |
| JP | H11314010 | A | 11/1999 |
| JP | 2000297392 | A | 10/2000 |
| JP | 2009191333 | A | 8/2009 |
| JP | 2012072477 | A | 4/2012 |
| JP | 2016204701 | A | 12/2016 |
| JP | 2018197364 | A | 12/2018 |
| JP | 2020163290 | A | 10/2020 |
| WO | 2012091128 | A1 | 7/2012 |

OTHER PUBLICATIONS

International Search Report (PCT/ISA/210) with translation and Written Opinion (PCT/ISA/237) mailed on Jan. 11, 2022, by the Japan Patent Office as the International Searching Authority for International Application No. PCT/JP2021/042828. (9 pages).

International Preliminary Report on Patentability mailed on May 30, 2023, by the Patent Office for Application No. PCT/JP2021/042828. (12 pages).

English translation of the Office Action/Search Report (Substantive Examination Adverse Report (Section 30(1)) issued on Dec. 30, 2025, by the Intellectual Property Corporation of Malaysian in corresponding Patent Application No. PI2023003177. (5 pages).

Office Action (Substantive Examination Report) issued on Dec. 30, 2025, in corresponding Saudi Arabian Patent Application No. 523441001 and English translation of the Office Action. (9 pages).

Office Action issued on Apr. 9, 2024, in corresponding Brazilian Patent Application No. BR112023010490-4 and informal English translation of the Preliminary Office Action. (5 pages).

Office Action (Hearing Notice) issued on Nov. 11, 2025, in corresponding Indian Patent Application No. 202337038686. (4 pages).

Office Action (Notice of Reasons for Refusal) issued on Nov. 25, 2025, in corresponding Japanese Patent Application No. 2022-566851 and machine English translation of the Office Action. (7 pages).

Office Action (Substantive Examination Report) issued on Nov. 4, 2025, in corresponding Philippines Patent Application No. 1/2023/551483. (5 pages).

Extended European Search Report issued on Mar. 26, 2025, in corresponding European Patent Application No. 21900450.4. (8 pages).

Office Action issued on Mar. 28, 2025, in corresponding Indian Patent Application No. 202337038686 and English translation of the Office Action. (6 pages).

Office Action/Search Report (The First Office Action) issued on Oct. 13, 2025, in corresponding Chinese Patent Application No. 202180080512.1 and machine English translation of the Office Action/Search Report. (14 pages).

Office Action (Report of Substantive Examination Stage I) issued on Dec. 18, 2025, in corresponding Indonesian Patent Application No. P00202305680 and English translation of the Office Action. (8 pages).

Office Action (Decision of Refusal) issued on Mar. 31, 2026, in corresponding Japanese Patent Application No. 2022-566851 and machine English translation of the Office Action. (5 pages).

Office Action (Substantive Examination Report) issued on Apr. 17, 2026, in corresponding Philippines Patent Application No. 1/2023/551483. (5 pages).

Office Action (The Second Office Action) issued on May 12, 2026, in corresponding Chinese Patent Application No. 202180080512.1 and machine English translation of the Office Action. (14 pages).

* cited by examiner

ORGANIC HYDRIDE PRODUCTION DEVICE, WATER REMOVAL DEVICE, AND WATER REMOVAL METHOD

CROSS-REFERENCE TO RELATED APPLICATIONS

This application is based upon and claims the benefit of priority from the prior Japanese Patent Application No. 2020-200979, filed on Dec. 3, 2020, and International Patent Application No. PCT/JP2021/042828, filed on Nov. 22, 2021, the entire content of each of which is incorporated herein by reference.

BACKGROUND

Field of the Invention

The present invention relates to an organic hydride production device, a water removal device, and a water removal method.

Description of the Related Art

Conventionally, an organic hydride production device including an electrolyzer having an anode electrode for generating protons from water, a cathode electrode for hydrogenating an organic compound (substance to be hydrogenated) having an unsaturated bond, and a membrane for separating the anode electrode and the cathode electrode is known (see, for example, Patent Literature 1). In this organic hydride production device, protons are generated by oxidation of water on the anode electrode, the protons move to the side of the cathode electrode through the membrane, and the substance to be hydrogenated is hydrogenated by the protons on the cathode electrode, so that an organic hydride is produced.

Patent Literature 1: WO2012/091128A

According to the above-described organic hydride production device, generation of the protons and hydrogenation of the substance to be hydrogenated can be performed by a one-step process. Therefore, the process for producing the organic hydride can be simplified as compared with a case where the organic hydride is produced by a two-step process in which hydrogen is produced by water electrolysis or the like and the substance to be hydrogenated is chemically hydrogenated in a reactor such as a plant. Or, production efficiency of the organic hydride can be improved. In addition, since it is possible to omit a high-pressure container for storing hydrogen which is required in the case of producing hydrogen by water electrolysis or the like, it is expected that equipment cost will be greatly reduced.

On the other hand, in the organic hydride production device described above, when the protons move through the membrane, water in the anode electrode moves to the side of the cathode electrode together with the protons. As a result of intensive studies, the present inventors have found that the dragged water having moved to the side of the cathode electrode can be accumulated at the bottom of the gas-liquid separation tower provided on the downstream side of the electrolyzer after being fed from the electrolyzer together with the organic hydride. Further, the present inventors have found that, when a circulation flow path is provided between a tank for storing the substance to be hydrogenated and the electrolyzer, the dragged water can also be accumulated at the bottom of the tank.

When the amount of the dragged water increases, the organic hydride or the substance to be hydrogenated may overflow from the gas-liquid separation tower or the tank. To address this, it is conceivable to suppress the overflow of the organic hydride or the substance to be hydrogenated by increasing the volume of the gas-liquid separation tower or the tank in consideration of the increase in the dragged water. However, increasing the volume of the gas-liquid separation tower or the tank causes an increase in size of the organic hydride production device.

SUMMARY OF THE INVENTION

The present invention has been made in view of such a situation, and an object thereof is to provide a technique for suppressing an overflow of an organic hydride or a substance to be hydrogenated while suppressing an increase in size of an organic hydride production device.

One aspect of the present invention is an organic hydride production device. This device includes: an electrolyzer having an anode electrode that oxidizes water in an anolyte to generate a proton, an anode chamber that equips the anode electrode, a cathode electrode that hydrogenates a substance to be hydrogenated in a catholyte with the proton to generate an organic hydride, a cathode chamber that equips the cathode electrode, and a membrane that separates the anode chamber and the cathode chamber and moves the proton together with dragged water from the side of the anode chamber to the side of the cathode chamber; and a water removal device that removes the dragged water from the catholyte fed from the cathode chamber and containing at least the organic hydride and the dragged water. The water removal device has a container that stores the catholyte fed from the cathode chamber, a drain pipe that is connected to the container and discharges the dragged water, a detector that detects that a predetermined amount of dragged water has been accumulated in the container, and a switcher that is provided in the drain pipe, can switch between a regulation state in which drainage from the drain pipe is regulated and an execution state in which the drainage is executed, and switches from the regulation state to the execution state based on a detection result of the detector.

Another aspect of the present invention is a water removal device. This device includes: a container that stores a catholyte fed from a cathode chamber of an electrolyzer and containing at least an organic hydride and dragged water, the electrolyzer having an anode electrode that oxidizes water in an anolyte to generate a proton, an anode chamber that equips the anode electrode, a cathode electrode that hydrogenates a substance to be hydrogenated in the catholyte with the proton to generate the organic hydride, the cathode chamber that equips the cathode electrode, and a membrane that separates the anode chamber and the cathode chamber and moves the proton together with the dragged water from the side of the anode chamber to the side of the cathode chamber; a drain pipe that is connected to the container and discharges the dragged water; a detector that detects that a predetermined amount of dragged water has been accumulated in the container; and a switcher that is provided in the drain pipe, can switch between a regulation state in which drainage from the drain pipe is regulated and an execution state in which the drainage is executed, and switches from the regulation state to the execution state based on a detection result of the detector.

Another aspect of the present invention is a water removal method. This method includes: storing, in a container, a catholyte fed from a cathode chamber of an electrolyzer and containing at least an organic hydride and dragged water, the electrolyzer having an anode electrode that oxidizes water in an anolyte to generate a proton, an anode chamber that equips the anode electrode, a cathode electrode that hydrogenates a substance to be hydrogenated in the catholyte with the proton to generate the organic hydride, the cathode chamber that equips the cathode electrode, and a membrane that separates the anode chamber and the cathode chamber and moves the proton together with the dragged water from the side of the anode chamber to the side of the cathode chamber; and when it is detected that a predetermined amount of dragged water has been accumulated in the container, discharging the dragged water from the container.

Any combinations of the above components and conversion of the expressions in the present disclosure between methods, devices, systems, and the like are also effective as aspects of the present disclosure.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE INVENTION

Figure 1:
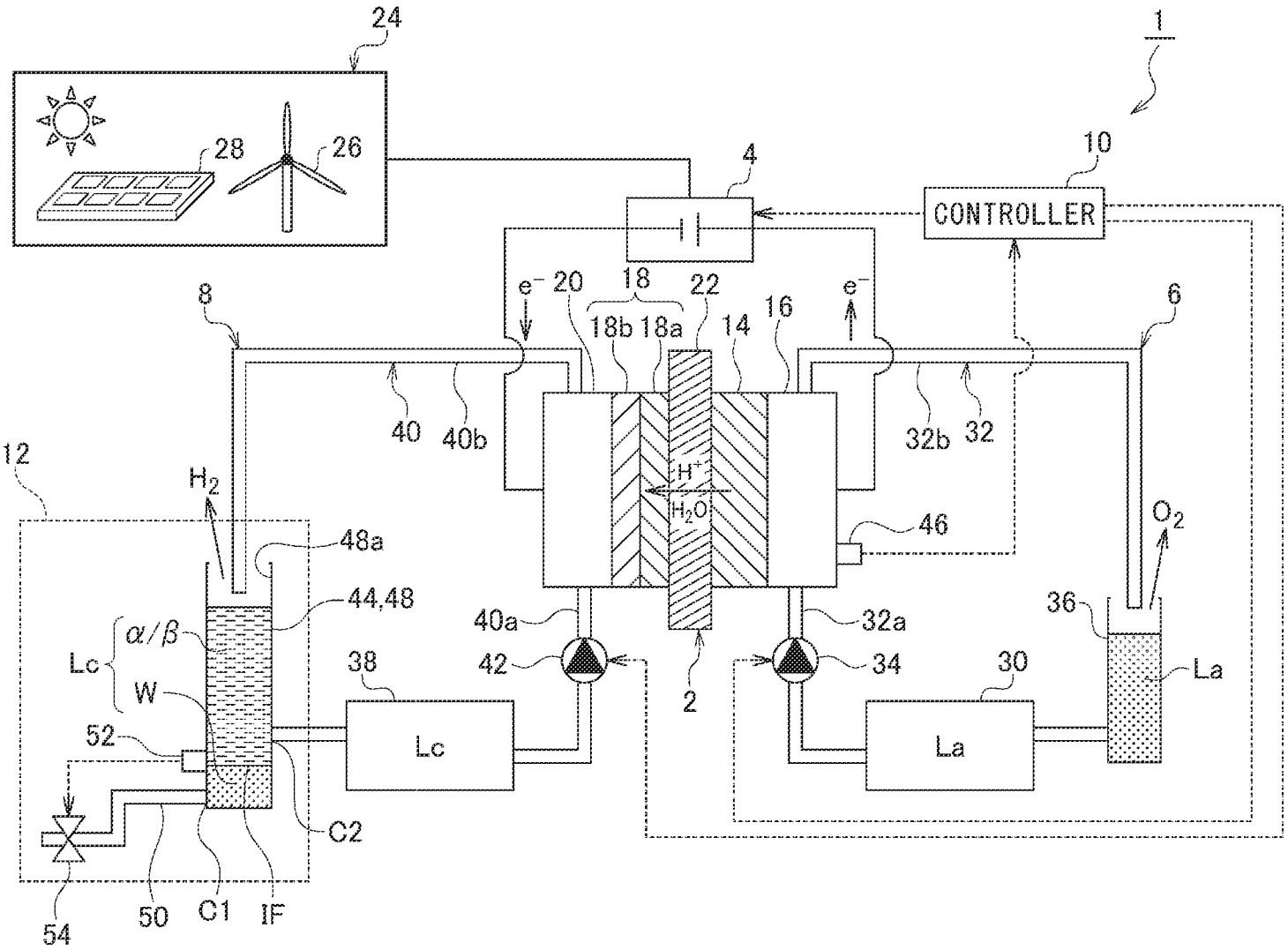
FIG. 1 is a schematic view of an organic hydride production device according to an embodiment.

Hereinafter, the present invention will be described based on preferred embodiments with reference to the drawings. The embodiments are illustrative rather than limiting the invention, and all features described in the embodiments and combinations thereof are not necessarily essential to the invention. The same or equivalent components, members, and processes illustrated in the drawings are denoted by the same reference numerals, and redundant description will be omitted as appropriate.

In addition, the scale and shape of each part illustrated in each drawing are set for convenience in order to facilitate the description, and are not to be limitedly interpreted unless otherwise specified. Furthermore, when the terms "first", "second", and the like are used in the present specification or claims, the terms do not represent any order or importance, but are used to distinguish one configuration from another configuration. In addition, in each drawing, some of members that are not important for describing the embodiments are omitted.

FIG. 1 is a schematic view of an organic hydride production device 1 according to an embodiment. The organic hydride production device 1 includes an electrolyzer 2, a power supply 4, a first circulation mechanism 6, a second circulation mechanism 8, a controller 10, and a water removal device 12.

The electrolyzer 2 is an electrolytic cell that generates an organic hydride β by hydrogenating a substance to be hydrogenated α by an electrochemical reduction reaction. The electrolyzer 2 has an anode electrode 14, an anode chamber 16, a cathode electrode 18, a cathode chamber 20, and a membrane 22.

The anode electrode 14 is an electrode (anode) that oxidizes water in an anolyte La to generate protons ($H^+$). The anode electrode 14 is disposed so as to be in contact with one main surface of the membrane 22. The anode electrode 14 has, for example, a metal such as iridium (Ir), ruthenium (Ru), or platinum (Pt), or a metal oxide thereof as an anode catalyst. In the anode electrode 14 as an example, the anode catalyst is dispersedly supported or coated on a base material having electron conductivity. The base material includes a material containing, for example, a metal such as titanium (Ti) or stainless steel (SUS) as a main component. Examples of the form of the base material include a woven fabric sheet or a nonwoven fabric sheet, a mesh, a porous sintered body, a foamed molded body (foam), and an expanded metal.

The thickness of the anode electrode 14 including the anode catalyst and the base material is not particularly limited, but is, for example, 0.05 to 1 mm. By setting the thickness of the anode electrode 14 to 0.05 mm or more, the amount of catalyst required for an electrolytic reaction can be more reliably obtained. In addition, by setting the thickness of the anode electrode 14 to 1 mm or less, it is possible to suppress an excessive decrease in diffusivity of the anolyte La.

Note that the anode catalyst may be coated on the base material to form a catalyst layer. In this case, the thickness of the catalyst layer is not particularly limited, but is, for example, 0.1 to 50 μm. The anode electrode 14 may have a layer structure that is obtained by directly coating a main surface of the membrane 22 with the anode catalyst. In this case, the thickness of the layer included in the anode electrode 14 is not particularly limited, but is, for example, 0.1 to 50 μm. By setting the thickness of the layer to 0.1 μm or more, the amount of catalyst required for the electrolytic reaction can be more reliably obtained. In addition, by setting the thickness of the layer to 50 μm or less, it is possible to suppress an excessive decrease in the diffusivity of the anolyte La.

The anode electrode 14 is equipped in the anode chamber 16. A space excluding the anode electrode 14 in the anode chamber 16 forms a flow path of the anolyte La and oxygen generated by an electrode reaction.

The cathode electrode 18 is an electrode (cathode) that hydrogenates the substance to be hydrogenated α in a catholyte Lc with protons to generate the organic hydride β. The cathode electrode 18 is disposed so as to be in contact with the other main surface (main surface opposite to the anode electrode 14) of the membrane 22. The cathode electrode 18 has a catalyst layer 18*a* and a diffusion layer 18*b*.

The catalyst layer 18*a* is disposed so as to be in contact with the membrane 22. The catalyst layer 18*a* contains, for example, platinum or ruthenium as a cathode catalyst. It is preferable that the catalyst layer 18*a* also has a catalyst support that supports the cathode catalyst. The catalyst support includes an electron-conductive material such as porous carbon, a porous metal, or a porous metal oxide. The thickness of the catalyst layer 18*a* is not particularly limited, but is, for example, 20 to 50 μm. By setting the thickness of the catalyst layer 18*a* to 20 μm or more, the amount of catalyst required for the electrolytic reaction can be more reliably obtained. In addition, by setting the thickness of the catalyst layer 18*a* to 50 μm or less, it is possible to suppress an excessive decrease in the diffusivity of the substance to be hydrogenated α.

The diffusion layer 18*b* is disposed to be in contact with a surface of the catalyst layer 18*a* on a side opposite to the membrane 22. The diffusion layer 18*b* is a layer that uniformly diffuses the liquid substance to be hydrogenated α supplied from the outside into the catalyst layer 18*a*. The organic hydride β generated in the catalyst layer 18*a* is discharged from the catalyst layer 18*a* through the diffusion layer 18*b*.

The diffusion layer 18*b* is formed of a conductive material such as carbon or a metal. In addition, the diffusion layer 18*b* is a porous body such as a sintered body of fibers or particles or a foamed molded body. Specific examples of the material forming the diffusion layer 18*b* include a carbon woven fabric (carbon cloth), a carbon nonwoven fabric, and carbon paper. The thickness of the diffusion layer 18*b* is not particularly limited, but is, for example, 200 to 700 μm. By setting the thickness of the diffusion layer 18*b* to 200 μm or more, the diffusivity of the substance to be hydrogenated α can be more reliably enhanced. In addition, by setting the thickness of the diffusion layer 18*b* to 700 μm or less, it is possible to suppress electrical resistance from becoming excessive.

The cathode electrode 18 is equipped in the cathode chamber 20. A space excluding the cathode electrode 18 in the cathode chamber 20 forms a flow path of the substance to be hydrogenated α and the organic hydride β generated by the electrode reaction.

The anode chamber 16 and the cathode chamber 20 are separated by the membrane 22. The membrane 22 is disposed between the anode electrode 14 and the cathode electrode 18. The membrane 22 as an example is formed of a solid polymer electrolyte membrane having proton conductivity. The solid polymer electrolyte membrane is not particularly limited as long as it is a proton-conducting material, and examples thereof include a fluorine-based ion exchange membrane having a sulfonic acid group such as Nafion (registered trademark).

The membrane 22 moves the protons with water ($H_2O$) from the side of the anode chamber 16 to the side of the cathode chamber 20. Hereinafter, water that moves together with protons is referred to as dragged water W. The thickness of the membrane 22 is not particularly limited, but is, for example, 5 to 300 μm. By setting the thickness of the membrane 22 to 5 μm or more, the desired strength of the membrane 22 can be more reliably obtained. In addition, by setting the thickness of the membrane 22 to 300 μm or less, it is possible to suppress ion migration resistance from becoming excessive.

A reaction that occurs when toluene (TL) is used as an example of the substance to be hydrogenated α in the electrolyzer 2 is as follows. The organic hydride β obtained in a case where toluene is used as the substance to be hydrogenated α is methylcyclohexane (MCH).

Electrode reaction at anode electrode: $2H_2O \rightarrow O_2 + 4H^+ + 4e^-$

Electrode reaction at cathode electrode: $TL + 6H^+ + 6e^- \rightarrow MCH$

That is, in the anode electrode 14, water is electrolyzed to generate oxygen gas, protons, and electrons. The protons move through the membrane 22 toward the cathode electrode 18. The electrons flow into a positive electrode of the power supply 4. The oxygen gas is discharged to the outside through the anode chamber 16. In the cathode electrode 18, methylcyclohexane is generated by the reaction of toluene, electrons supplied from a negative electrode of the power supply 4, and protons having reached through the membrane 22. Therefore, according to the organic hydride production device 1, the electrolysis of water and the hydrogenation reaction of the substance to be hydrogenated α can be performed in one step.

The power supply 4 is a DC power supply that supplies power to the electrolyzer 2. By the supply of power from the power supply 4, a predetermined electrolytic voltage is applied between the anode electrode 14 and the cathode electrode 18 of the electrolyzer 2. The power supply 4 receives power supplied from a power supplier 24 and supplies the power to the electrolyzer 2. The power supplier 24 as an example can include a renewable energy power generation device such as a wind power generation device 26, a solar power generation device 28, or the like. Note that the power supplier 24 may include a power generation device using renewable energy other than wind power and sunlight, such as a geothermal power generation device, a wave power generation device, a temperature difference power generation device, or a biomass power generation device. Note that the power supplier 24 is not limited to the power generation device that generates power using the renewable energy.

The first circulation mechanism 6 is a mechanism for allowing the anolyte La containing water flow into the anode chamber 16. The first circulation mechanism 6 has an anolyte tank 30, an anolyte circulation path 32, an anolyte circulation device 34, and an anolyte gas-liquid separator 36. The anolyte tank 30 stores the anolyte La to be supplied to the anode chamber 16. Examples of the anolyte La include a solution having predetermined ion conductivity such as a sulfuric acid aqueous solution, a nitric acid aqueous solution, or a hydrochloric acid aqueous solution, pure water, and ion-exchanged water.

The anolyte tank 30 and the anode chamber 16 are connected by the anolyte circulation path 32. The anolyte circulation path 32 has an anode inlet pipe 32*a* that supplies the anolyte La in the anolyte tank 30 to the anode chamber 16, and an anode outlet pipe 32*b* that returns the anolyte La fed from the anode chamber 16 to the anolyte tank 30.

As an example, the anolyte circulation device 34 is provided in the middle of the anode inlet pipe 32*a*. By driving the anolyte circulation device 34, the anolyte La flows in the anolyte circulation path 32. As a result, the anolyte La circulates between the anolyte tank 30 and the anode chamber 16. As the anolyte circulation device 34, for example, various pumps such as a gear pump and a cylinder pump, a natural flow-down type device, or the like can be used.

The anolyte gas-liquid separator 36 is provided in the middle of the anode outlet pipe 32*b*. In the anode electrode 14, oxygen is generated by an electrode reaction. Therefore, the anolyte La recovered from the anode chamber 16 contains gaseous oxygen and dissolved oxygen, in addition to unreacted water. The gaseous oxygen is separated from the anolyte La in the anolyte gas-liquid separator 36 and taken out of the system. The anolyte La from which the oxygen has been separated is recovered in the anolyte tank 30.

In the first circulation mechanism 6 as an example, the anode inlet pipe 32*a* is connected to a vertically lower portion of the anode chamber 16, and the anode outlet pipe 32*b* is connected to a vertically upper portion of the anode chamber 16. The anolyte La in the anolyte tank 30 is pumped up by the anolyte circulation device 34 and enters the anode chamber 16. The anolyte La in the anode chamber 16 is pushed out to the anode outlet pipe 32*b* by the flow of the anolyte La entering the anode chamber 16, and flows down to the anolyte gas-liquid separator 36 by the gravity. The anolyte La is placed under the atmospheric pressure in the anolyte gas-liquid separator 36. The anolyte La in the anolyte gas-liquid separator 36 flows into the anolyte tank 30 in a natural flow-down manner as a liquid level in the anolyte tank 30 decreases. Note that the anode inlet pipe 32*a* may be connected to the vertically upper portion of the anode chamber 16. In this case, the anolyte La enters the anode chamber 16 from the vertically upper portion. That is, the anolyte La may be supplied to the anode chamber 16 not as an upward flow but as a downward flow.

The second circulation mechanism 8 is a mechanism for allowing the catholyte Lc containing the substance to be hydrogenated α flow into the cathode chamber 20. The second circulation mechanism 8 has a catholyte tank 38, a catholyte circulation path 40, a catholyte circulation device 42, and a catholyte gas-liquid separator 44 (gas-liquid separation tower). The catholyte tank 38 stores the catholyte Lc supplied to the cathode chamber 20. The catholyte Lc stored in the catholyte tank 38 contains at least the substance to be hydrogenated α before the operation of the organic hydride production device 1 is started. The substance to be hydrogenated α is a compound that is hydrogenated by an electrochemical reduction reaction in the electrolyzer 2 to become the organic hydride β, in other words, a dehydrogenated product of the organic hydride β. The substance to be hydrogenated α and the organic hydride β are preferably a liquid at 20° C. and 1 atm.

The substance to be hydrogenated α and the organic hydride β are organic compounds capable of adding/eliminating hydrogen by reversibly causing a hydrogenation reaction/dehydrogenation reaction. The substance to be hydrogenated α and the organic hydride β have specific gravities smaller than that of water. Further, the substance to be hydrogenated α and the organic hydride β have low compatibility with water, and form an interface IF with the dragged water W.

In a case where a detector 52 described later includes a sensor that detects the interface IF based on a difference in buoyancy (specific gravity) applied to a float, the substance to be hydrogenated α and the organic hydride β having a difference in specific gravity with respect to the dragged water W to such an extent that the sensor can perform detection are selected. In this case, examples of the substance to be hydrogenated α include an aromatic compound in which the specific gravity of the liquid is 0.6 to 0.9 g/cm$^3$.

In addition, in a case where the detector 52 includes a sensor that detects the interface IF based on a difference in capacitance (relative permittivity), the substance to be hydrogenated α and the organic hydride β having a difference in relative permittivity with respect to the dragged water W to such an extent that the sensor can perform detection are selected. In this case, examples of the substance to be hydrogenated α include an aromatic compound in which the relative permittivity is 1 to 50.

Specific examples of the substance to be hydrogenated α include alkylbenzenes such as benzene and toluene, and nitrogen-containing aromatic compounds such as pyridine and pyrazine.

The catholyte tank 38 and the cathode chamber 20 are connected by the catholyte circulation path 40. The catholyte circulation path 40 has a cathode inlet pipe 40*a* that supplies the catholyte Lc in the catholyte tank 38 to the cathode chamber 20, and a cathode outlet pipe 40*b* that returns the catholyte Lc fed from the cathode chamber 20 to the catholyte tank 38. In the catholyte Lc flowing through the catholyte circulation path 40, as the operation time of the organic hydride production device 1 elapses, in other words, as the number of circulations increases, the concentration of the substance to be hydrogenated α decreases, and the concentration of the organic hydride β increases.

As an example, the catholyte circulation device 42 is provided in the middle of the cathode inlet pipe 40*a*. By driving the catholyte circulation device 42, the catholyte Lc flows in the catholyte circulation path 40. As a result, the catholyte Lc circulates between the catholyte tank 38 and the cathode chamber 20. As the catholyte circulation device 42, for example, various pumps such as a gear pump and a cylinder pump, a natural flow-down type device, or the like can be used.

The catholyte gas-liquid separator 44 is provided in the middle of the cathode outlet pipe 40*b*. In the cathode electrode 18, hydrogen is generated by a side reaction. As a concentration of the substance to be hydrogenated α supplied to the cathode electrode 18 decreases, the side reaction is more likely to occur. In other words, a ratio of the side reaction to the entire electrode reaction in the cathode electrode 18 increases. Therefore, the catholyte Lc recovered from the cathode chamber 20 contains gaseous hydrogen and dissolved hydrogen, in addition to the unreacted substance to be hydrogenated α and the generated organic hydride β. The gaseous hydrogen is separated from the catholyte Lc in the catholyte gas-liquid separator 44 and taken out of the system. The catholyte Lc from which hydrogen has been separated is recovered in the catholyte tank 38.

In the second circulation mechanism 8 as an example, the cathode inlet pipe 40*a* is connected to the vertically lower portion of the cathode chamber 20, and the cathode outlet pipe 40*b* is connected to the vertically upper portion of the cathode chamber 20. The catholyte Lc in the catholyte tank 38 is pumped up by the catholyte circulation device 42 and enters the cathode chamber 20. The catholyte Lc in the cathode chamber 20 is pushed out to the cathode outlet pipe 40*b* by the flow of the catholyte Lc entering the cathode chamber 20, and flows down to the catholyte gas-liquid separator 44 by the gravity. The catholyte Lc is placed under the atmospheric pressure in the catholyte gas-liquid separator 44. The catholyte Lc in the catholyte gas-liquid separator 44 flows into the catholyte tank 38 in a natural flow-down manner as a liquid level in the catholyte tank 38 decreases. Note that the cathode inlet pipe 40*a* may be connected to the vertically upper portion of the cathode chamber 20. In this case, the catholyte Lc enters the cathode chamber 20 from the vertically upper portion. That is, the catholyte Lc may be supplied to the cathode chamber 20 not as an upward flow but as a downward flow.

The controller 10 controls the operation of the organic hydride production device 1. The controller 10 is realized by an element or a circuit such as a CPU or a memory of a computer as a hardware configuration, and is realized by a computer program or the like as a software configuration, but is illustrated as a functional block realized by cooperation between them in FIG. 1. It should be understood by those skilled in the art that the functional blocks can be implemented in various forms by a combination of hardware and software.

A signal indicating a voltage of the electrolyzer 2, a signal indicating a potential of the anode electrode 14, or a signal indicating a potential of the cathode electrode 18 is input to the controller 10 from a sensor 46 provided in the electrolyzer 2. The sensor 46 can detect the potential of each electrode and the voltage of the electrolyzer 2 by a known method. The sensor 46 as an example includes a known voltmeter or the like. Note that FIG. 1 schematically illustrates the sensor 46. The sensor 46 may include a current detector that detects a current flowing between the anode electrode 14 and the cathode electrode 18. The controller 10 controls the power supply 4, the anolyte circulation device 34, the catholyte circulation device 42, and the like based on a detection result of the sensor 46.

The water removal device 12 is a device that removes the dragged water W from the catholyte Lc. As described above, the dragged water W moves from the side of the anode chamber 16 to the cathode chamber 20. Therefore, the catholyte Lc fed from the cathode chamber 20 contains not only the substance to be hydrogenated α and the organic hydride β but also the dragged water W. The water removal device 12 removes the dragged water W from the catholyte Lc.

The water removal device 12 has a container 48, a drain pipe 50, a detector 52, and a switcher 54. The container 48 stores the catholyte Lc fed from the cathode chamber 20. The container 48 according to the present embodiment is provided in the middle of the cathode outlet pipe 40*b*. The container 48 also serves as the catholyte gas-liquid separator 44. Therefore, an exhaust port 48*a* for discharging hydrogen in the catholyte Lc is provided in a vertically upper portion of the container 48.

The catholyte Lc stored in the container 48 contains the substance to be hydrogenated α, the organic hydride β, and the dragged water W. The substance to be hydrogenated α and the organic hydride β have specific gravities smaller than that of the dragged water W and have incompatibility with the dragged water W. Therefore, the catholyte Lc is divided into a lower layer (water layer) containing the dragged water W and an upper layer (oil layer) containing the substance to be hydrogenated α and the organic hydride β in the container 48.

The drain pipe 50 is connected to the container 48 to discharge the dragged water W accumulated in the container 48. One end of the cathode outlet pipe 40*b* is connected to the container 48. The other end of the cathode outlet pipe 40*b* is connected to the catholyte tank 38. One end of the drain pipe 50 is connected to the container 48. A connection position C1 of the drain pipe 50 with respect to the container 48 (catholyte gas-liquid separator 44) is disposed below a connection position C2 of the cathode outlet pipe 40*b* with respect to the container 48 in a vertical direction.

The detector 52 detects that a predetermined amount of dragged water W has been accumulated in the container 48. The "predetermined amount" can be appropriately set based on empirical knowledge, experiment, or the like. The detector 52 according to the present embodiment includes an interface sensor that detects an interface IF between a layer containing the substance to be hydrogenated α and the organic hydride β in the catholyte Lc and a layer containing the dragged water W. In the detector 52, a known interface sensor such as a float type interface sensor, a capacitance type interface sensor, or a conductivity type interface sensor can be used. In addition, a person skilled in the art can appropriately select a combination of the types of the substance to be hydrogenated α and the organic hydride β and the detection type of the interface sensor.

A detection position of the interface IF by the detector 52 is set below the connection position C2 of the cathode outlet pipe 40*b* in the vertical direction. The detection position of the interface IF is set above the connection position C1 of the drain pipe 50 in the vertical direction. The detector 52 may be disposed inside the container 48. Note that, when the container 48 does not inhibit the detection of the interface IF (for example, when the container 48 is made of a material capable of detecting the capacitance inside the container from the outside of the container), the detector 52 may be disposed outside the container 48. The detector 52 can detect accumulation of a predetermined amount of dragged water W in the container 48 by detecting the interface IF. When the detector 52 detects the interface IF, the detector 52 transmits a control signal to the switcher 54.

The switcher 54 is provided in the drain pipe 50. The switcher 54 includes a mechanism capable of switching between a regulation state in which drainage from the drain pipe 50 is regulated and an execution state in which drainage from the drain pipe 50 is executed. The switcher 54 of the present embodiment includes a valve. As the valve included in the switcher 54, for example, a known electromagnetic valve or the like can be used. Preferably, the valve included in the switcher 54 is a normally closed type electromagnetic valve that is closed at the time of non-energization and opened at the time of energization. In a state where the switcher 54 is closed, discharge of the dragged water W from the drain pipe 50 is regulated. When the switcher 54 is opened, discharge of the dragged water W from the drain pipe 50 is permitted (drainage of the dragged water W is executed). The switcher 54 opens the valve based on the detection result of the detector 52. That is, when the water level (interface IF) of the dragged water W rises to a detection position of the detector 52, the switcher 54 receives the control signal from the detector 52, is energized, and opens the valve, and the dragged water W is automatically discharged from the container 48. The amount of the dragged water W accumulated in the container 48 until the switcher 54 opens the valve is determined according to the size of the container 48 or the detection position of the interface IF.

When a predetermined time elapses after the valve opening, the switcher 54 closes the valve and regulates drainage. For example, a valve opening time of the switcher 54 is adjusted such that the valve is closed before the interface IF reaches the connection position C1 of the drain pipe 50. The valve opening time can be set in advance based on the amount of the dragged water W accumulated in the container 48 when the switcher 54 opens the valve, the drainage speed from the drain pipe 50, and the like. As a result, it is possible to suppress the substance to be hydrogenated α and the organic hydride β from being discharged from the drain pipe 50. The valve closing of the switcher 54 (switching to the regulation state) may be realized by control of the detector 52, or may be realized by a timer or the like that stops energization to the switcher 54 after a predetermined time elapses.

Note that the valve opening and closing of the switcher 54 may be controlled as follows. That is, the detector 52 has two interface sensors, and one interface sensor is disposed below the other interface sensor. A detection position of the interface IF in the upper interface sensor is set below the connection position C2, and a detection position of the interface IF in the lower interface sensor is set above the connection position C1. When the dragged water W is gradually accumulated and the interface IF rises, the interface IF is detected by the upper interface sensor. As a result, the switcher 54 is opened, the dragged water W is discharged, and the interface IF falls. When the interface IF is detected by the lower interface sensor, the switcher 54 is closed. This control can also suppress the substance to be hydrogenated α and the organic hydride β from being discharged from the drain pipe 50.

In the above description, the catholyte Lc circulates between the catholyte tank 38 and the cathode chamber 20. However, the present invention is not limited thereto, and the catholyte Lc fed from the cathode chamber 20 may not be returned to the catholyte tank 38. In this case, the catholyte Lc fed from the cathode chamber 20 can be stored in an organic hydride tank (not illustrated in the drawings) after passing through the catholyte gas-liquid separator 44.

In the above description, the catholyte Lc fed from the cathode chamber 20 contains the unreacted substance to be hydrogenated α. However, the present invention is not limited thereto, and there may be a case where all of the substance to be hydrogenated α supplied to the cathode chamber 20 are converted into the organic hydride β, and the substance to be hydrogenated α are not contained in the catholyte Lc fed from the cathode chamber 20.

Although only one electrolyzer 2 is illustrated in FIG. 1, the organic hydride production device 1 may have a plurality of electrolyzers 2. In this case, the respective electrolyzers 2 are arranged in the same direction such that the anode chamber 16 and the cathode chamber 20 are arranged in the same direction, and are stacked with an electric conduction plate interposed between the adjacent electrolyzers 2. As a result, the electrolyzers 2 are electrically connected in series. The electric conduction plate includes a conductive material such as a metal. Note that the electrolyzers 2 may be connected in parallel, or may be a combination of series connection and parallel connection. Further, the switcher 54 can include a pump. In this case, the switcher 54 receives the control signal from the detector 52, is driven, and executes drainage. In addition, the switcher 54 stops driving and regulates drainage, when a predetermined time elapses from execution of drainage.

As described above, the organic hydride production device 1 according to the present embodiment includes the electrolyzer 2 and the water removal device 12. The electrolyzer 2 has the anode electrode 14 that oxidizes water in the anolyte La to generate protons, the anode chamber 16 that equips the anode electrode 14, the cathode electrode 18 that hydrogenates the substance to be hydrogenated α in the catholyte Lc with the protons to generate the organic hydride β, the cathode chamber 20 that equips the cathode electrode 18, and the membrane 22 that separates the anode chamber 16 and the cathode chamber 20 and moves the protons together with the dragged water W from the side of the anode chamber 16 to the side of the cathode chamber 20. The water removal device 12 has the container 48 that stores the catholyte Lc fed from the cathode chamber 20, the drain pipe 50 that is connected to the container 48 and discharges the dragged water W, the detector 52 that detects that the predetermined amount of dragged water W has been accumulated in the container 48, and the switcher 54 that is provided in the drain pipe 50, is capable of switching between a regulation state in which drainage from the drain pipe 50 is regulated and an execution state in which drainage is executed, and switches from the regulation state to the execution state based on a detection result of the detector 52, and removes the dragged water W from the catholyte Lc containing at least the organic hydride β and the dragged water W fed from the cathode chamber 20.

As described above, the organic hydride production device 1 according to the present embodiment includes the water removal device 12 that detects that a predetermined amount of dragged water W has been accumulated in the container 48 and automatically discharges the dragged water W. When the detector 52 detects that the predetermined amount of dragged water W has been accumulated in the container 48, the dragged water W is discharged from the container 48. As a result, it is possible to suppress the organic hydride β or the substance to be hydrogenated α from overflowing from a container (downstream-side container), such as the catholyte gas-liquid separator 44, which is located on the downstream side of the cathode chamber 20 and at least temporarily stores the catholyte Lc, due to an increase in the dragged water W.

In addition, in a case where the overflow of the organic hydride β and the like is suppressed by storing the dragged water W in the enlarged downstream-side container, it is necessary to increase the volume of the downstream-side container so as to store the entire amount of dragged water W generated by the operation of the organic hydride production device 1. On the other hand, since the water removal device 12 performs drainage every time the amount of the dragged water W reaches the predetermined amount, the size required for the container 48 included in the water removal device 12 can be reduced. In addition, it is possible to avoid an increase in size of the downstream-side container. Therefore, it is possible to suppress an increase in size of the organic hydride production device 1.

In addition, in a case where the dragged water W is stored in the downstream-side container, a removal treatment of the dragged water W is required every time the operation of the organic hydride production device 1 is finished. On the other hand, since the water removal device 12 automatically performs drainage, such a treatment is unnecessary. Therefore, the production process of the organic hydride β can be simplified and the efficiency can be improved.

The organic hydride production device 1 of the present embodiment includes the catholyte tank 38 that stores the catholyte Lc supplied to the cathode chamber 20, the cathode inlet pipe 40*a* that is connected to the catholyte tank 38 and the cathode chamber 20 and supplies the catholyte Lc in the catholyte tank 38 to the cathode chamber 20, and the cathode outlet pipe 40*b* that is connected to the cathode chamber 20 and the catholyte tank 38 and returns the catholyte Lc fed from the cathode chamber 20 to the catholyte tank 38.

As described above, when the catholyte Lc repeatedly circulates between the catholyte tank 38 and the cathode chamber 20, the dragged water W may be fed into the cathode chamber 20 through the catholyte circulation path 40. When the dragged water W is fed into the cathode chamber 20, the amount of the dragged water W reaching the reaction field of the cathode electrode 18 increases, and the reduction reaction of the substance to be hydrogenated α can be inhibited. On the other hand, since the organic hydride production device 1 of the present embodiment includes the water removal device 12, it is possible to suppress the inhibition of the reduction reaction of the substance to be hydrogenated α by the dragged water W. Therefore, the production efficiency of the organic hydride can be effectively improved.

As a method for suppressing the entry of the dragged water W into the cathode chamber 20 through the catholyte circulation path 40, it is conceivable to visually check the water level of the dragged water W in the catholyte tank 38 and manually adjust the connection position of the cathode inlet pipe 40*a* with respect to the catholyte tank 38, according to the water level of the dragged water W. However, this method is very laborious. In addition, it is necessary to perform the drainage treatment after the operation of the organic hydride production device 1 is finished. On the other hand, since the water removal device 12 automatically performs drainage, the production process of the organic hydride β can be simplified and the efficiency can be improved.

The organic hydride production device 1 further includes the catholyte circulation device 42 provided in the middle of the cathode inlet pipe 40*a*. The container 48 of the water removal device 12 is provided in the middle of the cathode outlet pipe 40*b*. As compared with the cathode inlet pipe 40*a* provided with the catholyte circulation device 42, in the cathode outlet pipe 40*b* not provided with the catholyte circulation device 42, the flow of the catholyte Lc tends to be gentle. Therefore, according to the above-described arrangement configuration, the water removal device 12 can be installed in a region where the flow of the catholyte Lc is likely to be more gentle, and the dragged water W can be more stably accumulated at the bottom of the container 48. Therefore, the removal efficiency of the dragged water W can be enhanced.

The container 48 of the present embodiment also serves as the catholyte gas-liquid separator 44. As a result, it is possible to suppress an increase in cost associated with installation of the water removal device 12 as compared with a case where the container 48 is separately provided. In addition, it is possible to suppress an increase in size of the organic hydride production device 1.

The detector 52 according to the present embodiment includes an interface sensor that detects an interface IF between the layer containing at least the organic hydride β in the catholyte Lc and the layer containing the dragged water W (in a case where the catholyte Lc contains the substance to be hydrogenated α, an interface IF between the layer of the substance to be hydrogenated α and the organic hydride β and the layer of the dragged water W). As a result, it is possible to easily detect the dragged water W accumulated in the container 48. Therefore, a configuration of the water removal device 12 can be simplified.

Hereinabove, the embodiments of the present invention have been described in detail. The above-described embodiments are merely specific examples for carrying out the present invention. The contents of the embodiments do not limit the technical scope of the present invention, and many design changes such as changes, additions, and deletions of components can be made without departing from the spirit of the invention defined in the claims. A new embodiment to which the design change is made has the combined effect of each of the embodiment and the modification. In the above-described embodiment, the contents that can be subjected to such design changes are emphasized with notations such as "of the present embodiment" and "in the present embodiment", but the design changes are allowed even in the contents without such notations. Any combination of the above-described components is also effective as an aspect of the present invention.

Modification

Figure 2:
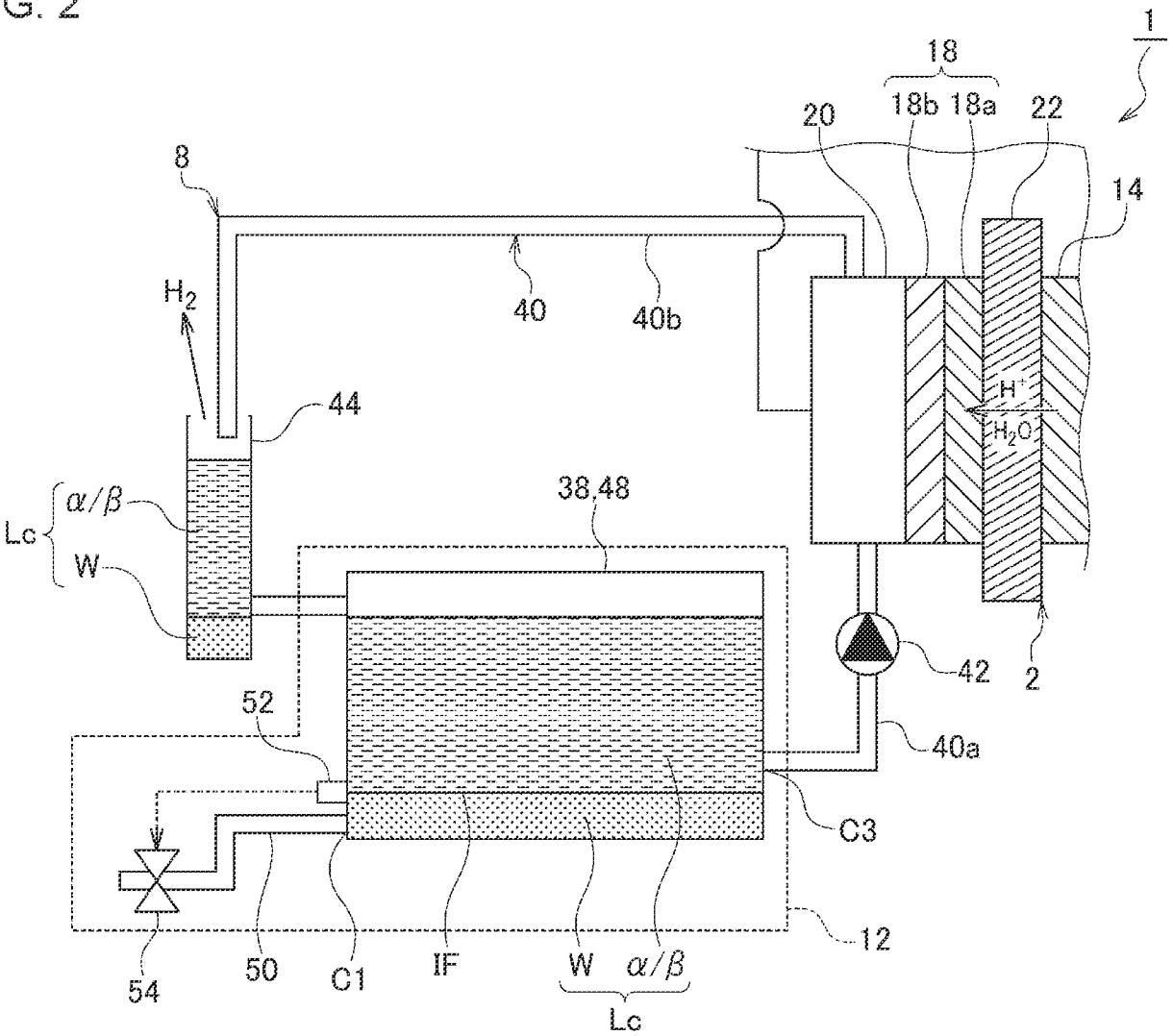
FIG. 2 is a schematic view of a part of an organic hydride production device according to a modification.

The present modification has a configuration common to the embodiment, except for the arrangement of the water removal device 12. Hereinafter, the present modification will be described focusing on a configuration different from that of the embodiment, and description of the common configuration will be omitted. FIG. 2 is a schematic view of a part of an organic hydride production device 1 according to the modification. An electrolyzer 2, a power supply 4, a first circulation mechanism 6, a controller 10, and a power supplier 24 in the present modification include configurations similar to those of the embodiment.

A second circulation mechanism 8 has a catholyte tank 38, a catholyte circulation path 40, a catholyte circulation device 42, and a catholyte gas-liquid separator 44. In the embodiment, the water removal device 12 is provided in the catholyte gas-liquid separator 44, but in the present modification, the water removal device 12 is provided in the catholyte tank 38. Except for this point, each configuration of the second circulation mechanism 8 is similar to that of the embodiment.

The water removal device 12 has a container 48, a drain pipe 50, a detector 52, and a switcher 54. The container 48 of the present modification also serves as the catholyte tank 38. The catholyte Lc stored in the container 48 contains the substance to be hydrogenated α, the organic hydride β, and the dragged water W. The catholyte Lc is divided into a lower layer containing the dragged water W and an upper layer containing the substance to be hydrogenated α and the organic hydride β in the container 48.

One end of the drain pipe 50 is connected to the container 48. One end of the cathode inlet pipe 40*a* is connected to the container 48. The other end of the cathode inlet pipe 40*a* is connected to the cathode chamber 20. A connection position C1 of the drain pipe 50 with respect to the container 48 (catholyte tank 38) is disposed below a connection position C3 of the cathode inlet pipe 40*a* with respect to the container 48 in a vertical direction. Naturally, the connection position C1 is disposed below a connection position of the cathode outlet pipe 40*b* with respect to the container 48 in the vertical direction.

The detector 52 detects that a predetermined amount of dragged water W has been accumulated in the container 48. The detector 52 as an example includes an interface sensor. A detection position of the interface IF by the detector 52 is set below the connection position C3 of the cathode inlet pipe 40*a* in the vertical direction. The detection position of the interface IF is set above the connection position C1 of the drain pipe 50 in the vertical direction.

The switcher 54 is provided in the drain pipe 50 and is capable of switching between a regulation state in which drainage from the drain pipe 50 is regulated and an execution state in which drainage from the drain pipe 50 is executed. The switcher 54 of the present modification includes a valve similarly to the embodiment, and opens the valve based on a detection result of the detector 52. That is, when a water level of the dragged water W rises to the detection position of the detector 52, the switcher 54 receives a control signal from the detector 52, is energized, and opens the valve, and the dragged water W is automatically discharged from the container 48. In addition, the switcher 54 as an example closes the valve when a predetermined time elapses from the valve opening. Similarly to the embodiment, opening and closing control of the switcher 54 using two interface sensors can also be adopted. Further, the switcher 54 can include a pump.

The organic hydride production device 1 according to the present modification can also obtain effects similar to those of the organic hydride production device 1 according to the embodiment. Note that the container 48 included in the catholyte tank 38 may be provided with the exhaust port 48*a*, and the container 48 of the water removal device 12 may also serve as the catholyte tank 38 and the catholyte gas-liquid separator 44. Also in the first circulation mechanism 6, the anolyte gas-liquid separator 36 and the anolyte tank 30 may be integrated.

The embodiments may also be specified as the items described below.

Item 1

A water removal device (12) including:

a container (48) that stores a catholyte (Lc) fed from a cathode chamber (20) of an electrolyzer (2) and containing at least an organic hydride (13) and dragged water (W), the electrolyzer (2) having an anode electrode (14) that oxidizes water in an anolyte (La) to generate a proton, an anode chamber (16) that equips the anode electrode (14), a cathode electrode (18) that hydrogenates a substance to be hydrogenated (α) in the catholyte (Lc) with the proton to generate the organic hydride (β), the cathode chamber (20) that equips the cathode electrode (18), and a membrane (22) that separates the anode chamber (16) and the cathode chamber (20) and moves the proton together with the dragged water (W) from the side of the anode chamber (16) to the side of the cathode chamber (20);

a drain pipe (50) that is connected to the container (48) and discharges the dragged water (W);

a detector (52) that detects that a predetermined amount of dragged water (W) has been accumulated in the container (48); and a switcher (54) that is provided in the drain pipe (50), can switch between a regulation state in which drainage from the drain pipe (50) is regulated and an execution state in which the drainage is executed, and switches from the regulation state to the execution state based on a detection result of the detector (52).

Item 2

A water removal method including:

storing, in a container (48), a catholyte (Lc) fed from a cathode chamber (20) of an electrolyzer (2) and containing at least an organic hydride (β) and dragged water (W), the electrolyzer (2) having an anode electrode (14) that oxidizes water in an anolyte (La) to generate a proton, an anode chamber (16) that equips the anode electrode (14), a cathode electrode (18) that hydrogenates a substance to be hydrogenated (α) in the catholyte (Lc) with the proton to generate the organic hydride (β), the cathode chamber (20) that equips the cathode electrode (18), and a membrane (22) that separates the anode chamber (16) and the cathode chamber (20) and moves the proton together with the dragged water (W) from the side of the anode chamber (16) to the side of the cathode chamber (20); and when it is detected that a predetermined amount of dragged water (W) has been accumulated in the container (48), discharging the dragged water (W) from the container (48).

The invention claimed is:

1. An organic hydride production device comprising:

an electrolyzer having an anode electrode that oxidizes water in an anolyte to generate a proton, an anode chamber that equips the anode electrode, a cathode electrode that hydrogenates a substance to be hydrogenated in a catholyte with the proton to generate an organic hydride, a cathode chamber that equips the cathode electrode, and a membrane that separates the anode chamber and the cathode chamber and moves the proton together with dragged water from the side of the anode chamber to the side of the cathode chamber; and a water removal device structured to remove the dragged water from the catholyte fed from the cathode chamber and containing at least the organic hydride and the dragged water, wherein the water removal device has a container that stores the catholyte fed from the cathode chamber, a drain pipe that is connected to the container and discharges the dragged water, a detector that detects that a predetermined amount of the dragged water has been accumulated in the container, and a switcher that is provided in the drain pipe, is capable of switching between a regulation state in which drainage from the drain pipe is regulated and an execution state in which the drainage is executed, and switches from the regulation state to the execution state based on a detection result of the detector.

2. The organic hydride production device according to claim 1, comprising:

a catholyte tank structured to store the catholyte supplied to the cathode chamber;

an inlet pipe connected to the catholyte tank and the cathode chamber and structured to supply the catholyte in the catholyte tank to the cathode chamber; and an outlet pipe connected to the cathode chamber and the catholyte tank and structured to return the catholyte fed from the cathode chamber to the catholyte tank.

3. The organic hydride production device according to claim 2, comprising:

a catholyte circulation device provided in the middle of the inlet pipe, wherein the container is provided in the middle of the outlet pipe.

4. The organic hydride production device according to claim 3, wherein the container also serves as a gas-liquid separator of the catholyte.

5. The organic hydride production device according to claim 2, wherein the container also serves as the catholyte tank.

6. The organic hydride production device according to claim 1, wherein the detector includes an interface sensor that detects an interface between a layer containing at least the organic hydride in the catholyte and a layer containing the dragged water.

7. A water removal method comprising:

storing, in a container, a catholyte fed from a cathode chamber of an electrolyzer and containing at least an organic hydride and dragged water, the electrolyzer having an anode electrode that oxidizes water in an anolyte to generate a proton, an anode chamber that equips the anode electrode, a cathode electrode that hydrogenates a substance to be hydrogenated in the catholyte with the proton to generate the organic hydride, the cathode chamber that equips the cathode electrode, and a membrane that separates the anode chamber and the cathode chamber and moves the proton together with the dragged water from the side of the anode chamber to the side of the cathode chamber;

detecting, by a detector, that a predetermined amount of the dragged water has been accumulated in the container; and switching, by a switcher provided in a drain pipe that is connected to the container, between a regulation state in which drainage from the drain pipe is regulated and an execution state in which the drainage is executed, based on the detecting by the detector, thereby discharging the dragged water from the container.

* * * * *